US005124093A

United States Patent [19]

Schimpff

[11] Patent Number: 5,124,093

[45] Date of Patent: Jun. 23, 1992

[54] PROCESS FOR THE PRODUCTION OF CONCRETE SWITCH CROSS TIES

[75] Inventor: Frithjof Schimpff, Wiesbaden, Fed. Rep. of Germany

[73] Assignee: Wayss & Freytag Aktiengesellschaft, Frankfurt am Main, Fed. Rep. of Germany

[21] Appl. No.: 434,683

[22] PCT Filed: Jun. 8, 1989

[86] PCT No.: PCT/EP89/00644

§ 371 Date: Oct. 5, 1989

§ 102(e) Date: Oct. 5, 1989

[87] PCT Pub. No.: WO90/00647

PCT Pub. Date: Jan. 25, 1990

[30] Foreign Application Priority Data

Jul. 14, 1988 [DE] Fed. Rep. of Germany ..... 3823860

[51] Int. Cl.[5] ..... B28B 1/14; B28B 13/06

[52] U.S. Cl. ..... 264/40.1; 249/86; 264/154; 264/156; 264/219; 264/228; 264/229; 264/277; 264/278; 264/279; 264/279.1; 264/297.9; 264/333; 264/334; 264/337; 425/111; 425/121; 425/123

[58] Field of Search ..... 264/40.1, 138, 333, 264/219, 228, 277, 229, 279, 256, 334, 35, 261, 263, 279.1, 297.9, 39, 40.5, 278, 337, 338, 313, 316, 154–156; 425/111, 121, 123; 249/86, 94, 97

[56] References Cited

U.S. PATENT DOCUMENTS

| | | | |
|---|---|---|---|
| 3,685,783 | 8/1972 | Hilson | 249/86 X |
| 4,102,957 | 7/1978 | Da Re | 264/333 X |
| 4,242,071 | 12/1980 | Stinton | 425/111 |
| 4,290,991 | 9/1981 | Thim | 425/111 X |
| 4,495,127 | 1/1985 | Thim . | |
| 4,738,605 | 4/1988 | Aerts et al. | 425/111 X |

FOREIGN PATENT DOCUMENTS

| | | | |
|---|---|---|---|
| 1584397 | 5/1970 | Fed. Rep. of Germany . | |
| 133077 | 6/1978 | Fed. Rep. of Germany . | |
| 3440247 | 5/1986 | Fed. Rep. of Germany . | |
| 1256967 | 9/1986 | U.S.S.R. | 249/97 |

OTHER PUBLICATIONS

Die Bundesbahn Band 9 Sep. 1982 (De) H. Schultheiss: "Erstmals Bei Der DB: Weiche Auf Spannbetonschwellen".

Revue Generale Des Chemins De Fer, Band 221, Feb. 1986, Gaughier-Villars, (Paris, FR) J. Oeconomos et al.: "Branchement Deux Voies Sur Plancher En Beton Precontraint".

*Primary Examiner*—Karen Aftergut

*Attorney, Agent, or Firm*—Herbert Dubno; Andrew Wilford

[57] ABSTRACT

In casings for switch cross ties, the bottom plate 3 serves at the same time as a pattern for the position of the construction components. As a rule, a new casing is prepared for each series of cross-ties type. In small series with various positions of the construction components it is economical to use the bottom plate repeatedly. This is done by providing the bottom plate, prior to its insertion in the casing, with holes (A,B,C) for several types of finished parts, by provisionally closing the unnecessary holes by suitable means and by finding the combination of holes required for the production of a certain type of finished part through a certain searching procedure and freeing them of their provisional closing means.

2 Claims, 4 Drawing Sheets

PROCESS FOR THE PRODUCTION OF CONCRETE SWITCH CROSS TIES

CROSS REFERENCE TO RELATED APPLICATIONS

This application is a national phase application of PCT/EP89/00644 filed Jun. 8, 1989 and based upon German national application P38 23 860.8 filed Jul. 14, 1988 under the International Convention.

1. Field of the Invention

My present invention relates to a process for the production of concrete switching cross ties in a prestressing-bed casing whose bottom plate has holes through which means can be asserted for fixing fastening devices for construction elements of the cross ties during the pouring of the concrete and which are repeatedly insertable for cross ties of different lengths and different arrangements of the construction components.

2. Background of the Invention

As a rule, because of the large-series production, casings for concrete series-produced finished parts are manufactured very rigidly and expensively. This applies particularly to cross ties produced in succession in a prestressing bed. In these cases, there are very high demands for a particularly accurate measurement of the position of the construction components. Therefore, the construction elements are fastened in bores of the casing, which have to be measured extremely accurately.

In the case of cross ties, the construction components, e.g.; anchor screws or tube sockets for the fastening screws of the track cross ties, are located on the upper side of the cross tie. The upper side of the cross tie lies in the casing, on the casing bottom. Thus, the bottom plate serves as a pattern for the insertion of the construction components.

In large series, a hole template is often used. The pattern which has to be produced for each type of cross ties influences the cost of the individual cross tie only slightly. But in the case of smaller production series of a certain cross-tie type, the costs related to the bottom plate serving as a pattern for the construction components can make the process uneconomical.

Particularly complicated is the making of the holes in the patterns for the switch cross ties. In normal track ties, the rail axes cross the cross ties perpendicularly. The construction components for the fastening of the rail to the cross tie and correspondingly the bores fixing them to the bottom plate of the casing are located on the median axis, in the case of normal track ties. Things are different in the case of switch cross ties: Here as a rule, the rail axes cross the cross tie axes at various angles, usually not right angles. Up to now, for the fastening of rail tracks which were not crossing at right angles also axially bored slabs were also used and required construction components arranged in numerous axes scattered over the surface of the cross ties for the fastening screws of the slabs and corresponding boreholes for the fastening of the construction components in the bottom plate of the casing. A casing for switch cross ties made of concrete is known from the German patent 3440247. This casing has a bottom plate made of steel which is embedded with accuracy of fit between lateral parts. The production of new bottom plates with holes on different spots and their insertion is expensive.

Objects of the Invention

It is the object of the invention to provide a process according to which a bottom plate of a prestressing-bed casing for the production of smaller series of concrete switch cross ties with various arrangements of the construction components can be repeatedly used.

SUMMARY OF THE INVENTION

These objects and others which will become apparent hereinafter in a process wherein, according to a first aspect, after the first use of the bottom plate, a thin, nonslidable covering is applied to the bottom plate which covers the holes of the previous use, and, depending on the respective selected material, is thick enough to extend over the covered holes even under the load created by the pressure of fresh concrete during the finishing operation and to remain undamaged, and whereupon the position of the fastening devices corresponding to the new use are marked.

In a second aspect of the invention, the bottom plate, prior to its insertion in the casing is provided with holes for several types of cross ties, the holes can be provisionally closed by suitable means, and the hole combination required for the production of a certain type of cross tie can be found through certain searching procedures and freed of the provisional closing means.

In a third aspect of the invention the bottom plate is provided with holes in a fixed pattern-suitably arranged on the longitudinal axis and/or on axes running parallelly thereto—and at certain intervals, the holes are provisionally closed by suitable means and the hole combination required by the production of a certain type of finished part is found through a certain searching procedure and freed of the provisional closing means.

In the first aspect of the invention, the bottom plate for the production of a further type of cross ties with the thereto pertaining combination of holes is bored out of site or after completion. This process step still requires considerable labor costs. The thin covering according to the invention, made of a tough material, extends over the holes which are not used and due to the selected strength and thickness and keeps them undamaged during the pouring of the concrete. This can be done for every new type of finished part and can be produced without great expense. The markings for the position of the construction components can be done with computer assistance, so that the covering can also serve as a pattern for the holes. The production of such a covering made of thin sheet metal, plastic or synthetic paper is considerably more cost-effective than the production of a new steel bottom plate for the casing.

In the second aspect of the invention, the bottom plate is provided in advance with the holes required by all types of finished parts it is supposed to be used for, and in a single process step, e.g. possibly electronically programmed and controlled, prior to the insertion in the casing it is drilled and the holes are provisionally closed by plugs, for instance of synthetic material or through plastering. In a second process step, the holes required for the production of a certain type of finished part have to be searched for and found in the bottom plate, opened and then fitted with holding devices for the construction components,—in this case the tube sockets. This searching can be done with search patterns or also with electronically programmed equipment. The process avoids later drilling work on the bottom plate, but is limited in use to the types cross ties whose hole combinations it presents.

The third aspect of the invention affords complete independence from a prior selection of the cross tie types. The bottom plate is provided with holes, or a through-running slot, in a fixed pattern suitably on the median axis and/or on axes running parallel thereto and at equal distances. This way, the fastening devices for the tube sockets in the cross ties and the boltings for the slab can be located only at certain points of the cross tie. These points do not necessarily have to be points which are located in the longitudinal axis of the slab.

This aspect of the process requires possibly slight deviations from the median axis of the holes on the slab, in that during the production of the cross tie no pattern holes of the bottom plate can be directly covered by a hole located in the median axis of the slab.

In comparison to the second aspect, wherein each time only the length of a finished part is covered by the casing plate in the prestressing bed and the casing plates are separated by stopping devices, according to the third aspect, the length of several finished parts or of the entire prestressing bed can be covered by casing plates. The stopping devices are set in this case on the bottom plate. An automatization of the insertion of the stopping devices and of the construction components in the casing becomes possible.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
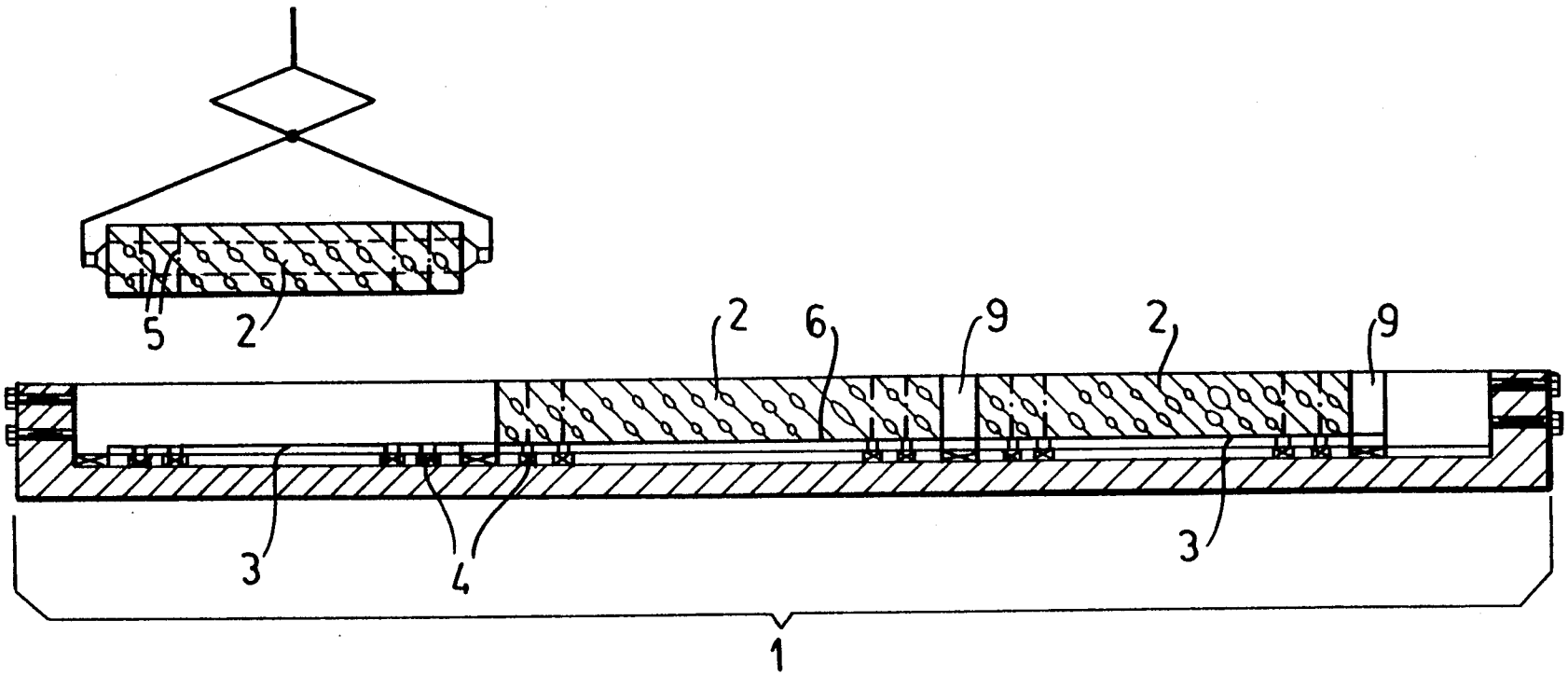
FIG. 1 is a prestressing bed with series-produced finished part in section.

In a manufacturing installation 1 for concrete finished parts in a prestressing bed, cross ties 2 are produced one after the other between lateral casings on bottom plates 3. Cross ties arranged in succession are separated in the casing by stopping devices 9. In the bottom plates 3, holes 4 establish the position of construction components 5 in the cross ties 2.

Figure 2:
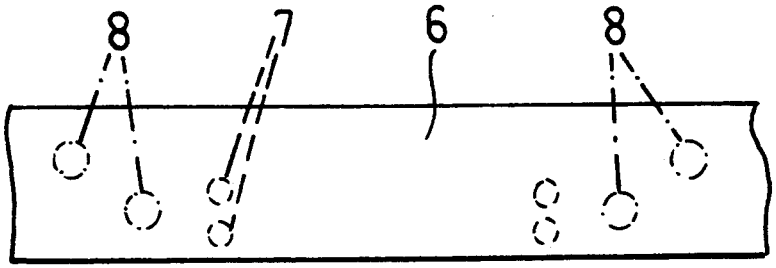
FIG. 2 is a top view of the covering according to the first aspect of the process, glued to the bottom plate.
Figure 3:
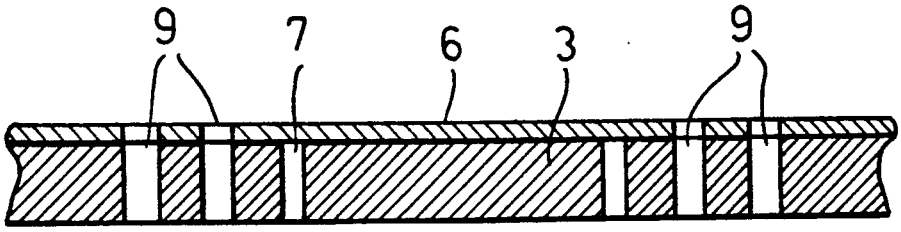
FIG. 3 is a vertical section through the covering and the bottom plate of FIG. 2.
Figure 8:
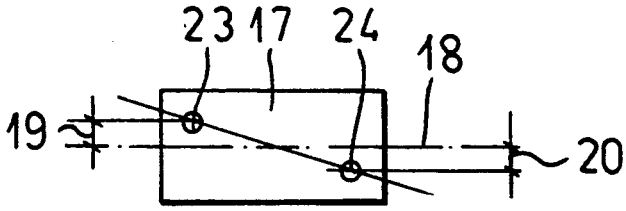
FIG. 8 is a slab with holes drilled eccentrically with respect to the longitudinal axis, according to the third aspect of the process.

FIGS. 2 and 3 show a covering 6 of the bottom plate 3, according to the first aspect of the process, whereupon the corresponding new positions of the construction components are marked. This covering 6, which for instance can be glued covers the holes 7 of the bottom plate 3 left over from previous uses. On the marks 8 previously made on the covering 6, through the covering 6 and in the same position therewith the holes 9 of the hole combination for the position of the construction components for the new use are drilled in the bottom plate 3.

Figure 4:
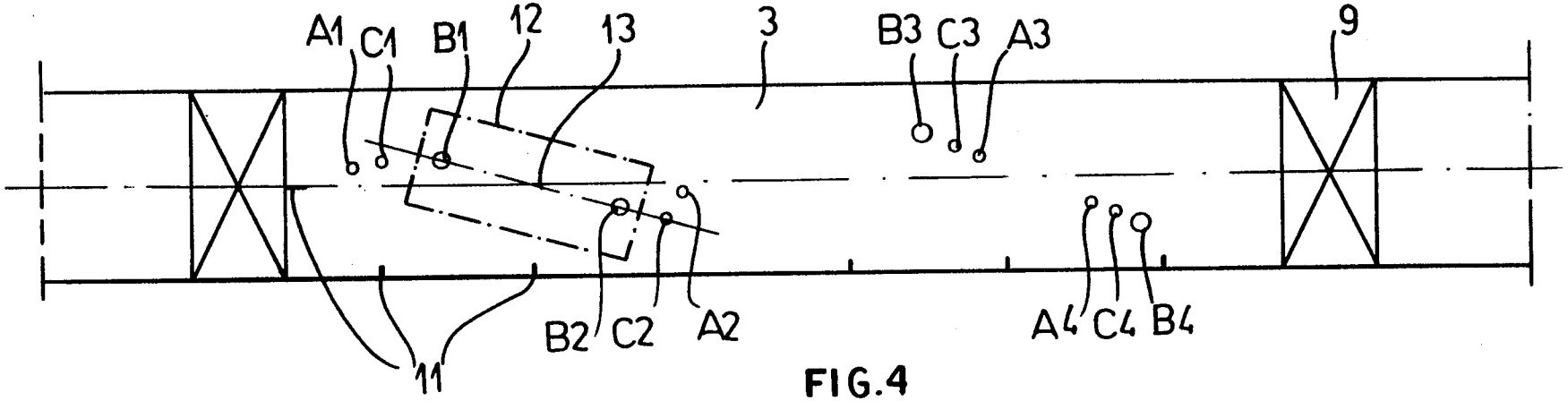
FIG. 4 is a top view of a bottom plate produced according to the first aspect of the process.
Figure 5:
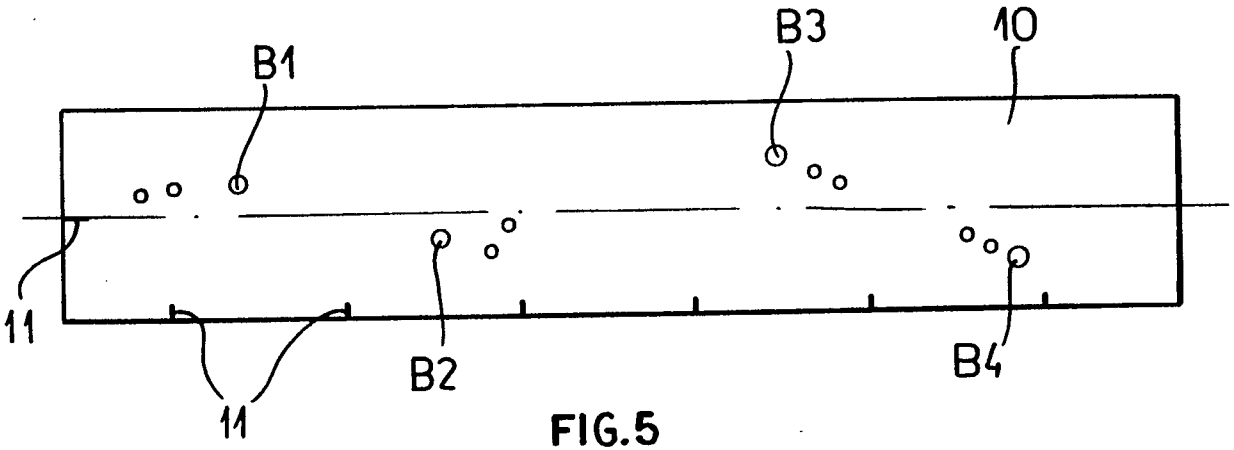
FIG. 5 is a search pattern for a definite cross tie of the B type with the assistance of which the holes pertaining to this type are found, opened and fitted with the fastening devices.

The bottom plate 3 according to a second aspect of the process shown in the embodiment example of FIGS. 4 and 5 presents the holes $A_1$–$A_n$, $B_1$–$B_n$, $C_1$–$C_n$, etc. The bottom plate 3 covers only the length of one cross tie in the prestressing bed. Between the bottom plates 3, stopping devices 9 are interspersed. With the aid of a search pattern 10, the holes $B_1$–$B_n$ pertaining to a certain type B of cross tie can be found. The search pattern 10 is adjusted with the aid of adjustment marks 11, which are marked on the search pattern as well as on the bottom plate. The holes $B_1$–$B_n$ pertaining to type B cross ties are indicated in the outer field of the other holes $A_1$–$A_n$, $C_1$–$C_n$, and so on, and marked in a particular way. This way, they are clearly findable in the outer field of the other holes, and the plugs can be removed from these holes and the fastening devices for the tube sockets can be inserted.

On the hole pattern of the bottom plate 3, the outline 2 of a normal slab provided with holes in the longitudinal axis 3 is entered.

Figure 6:
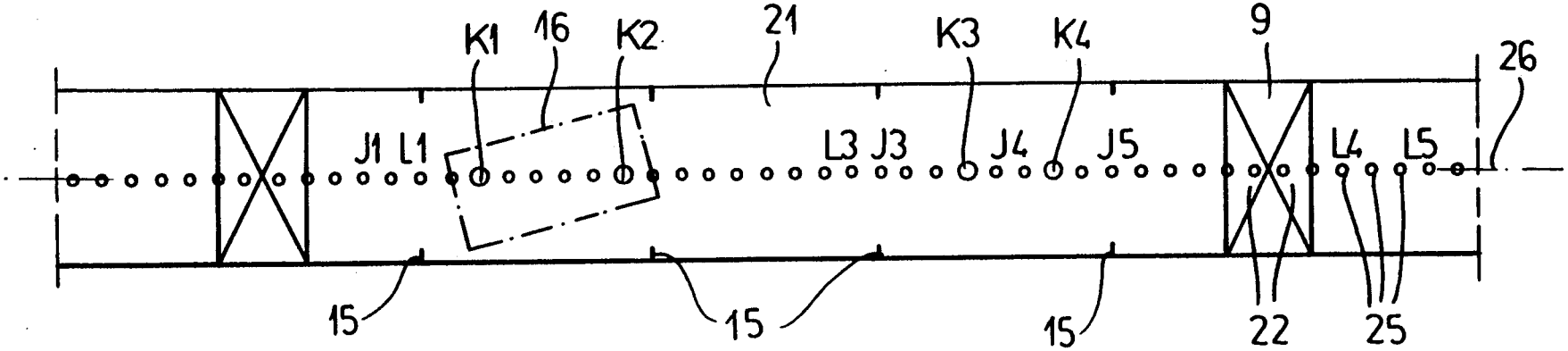
FIG. 6 is a top view of a bottom plate produced according to the third aspect of the process and running continuously.
Figure 7:
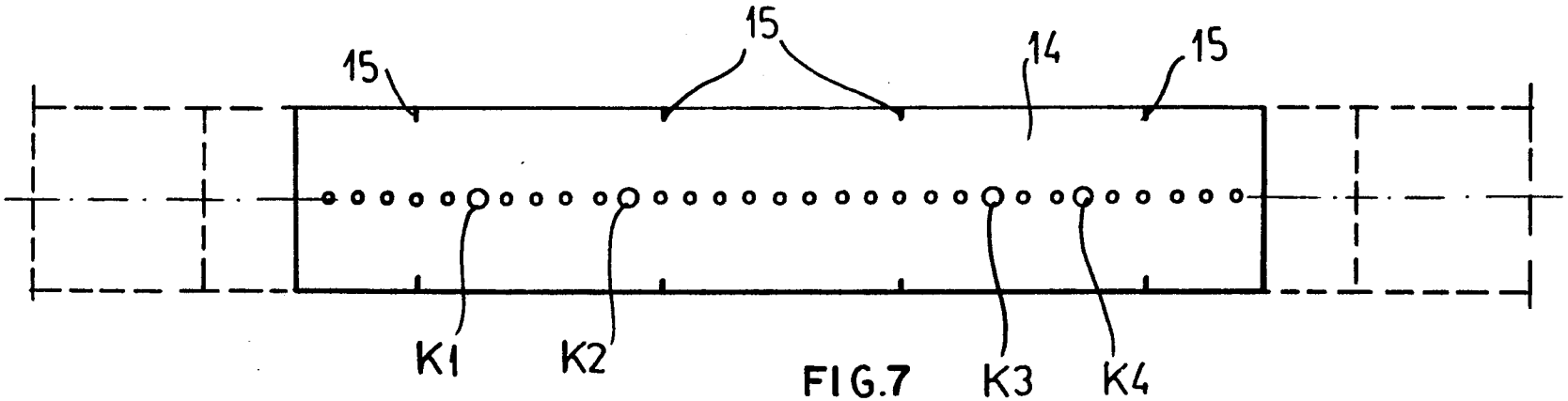
FIG. 7 is the search pattern for searching for and opening the holes pertaining to a certain cross-tie type K in a bottom plate according to FIG. 6, wherein the respective fastening devices can then be inserted.

The FIGS. 6 and 7 show a continuous bottom plate 21 provided with a fixed pattern of holes 25. The holes 25 are arranged in the median axis 26 at equal distances from each other. A search pattern 14 is adjusted to the bottom plate 21, with the aid of adjustment marks 15, which are marked on the bottom plate 21 as well as on the search pattern 14. The holes $K_1$–$K_n$ pertaining to type K cross ties are indicated in the outer field of the holes $J_1$–$J_n$, $L_1$–$L_n$, etc of the other remaining cross-tie types, and are marked in a special way. With aid of the special markings along the outer field, the holes to be utilized can be easily found between the surrounding holes, freed from the plugs and fitted with the tube sockets, respectively fastening devices for the insertion of the construction components. In the same way, the holes 22 for the fixation of the stopping devices 9 are found. On the drilling pattern of the bottom plate 21, the outline 16 of a slab 17 drilled in a special manner, is entered. The holes 23, 24 do not lie on the median axis 18 of the slab 17, but outside this axis by measures 19, 20, which as a rule differ, so that they can register with the thereto pertaining pattern holes $K_1$, $K_2$.

I claim:

1. A process for making a concrete switch cross tie, the process comprising the steps of sequentially:

a) providing on each of a large number of throughgoing plate holes formed in a mold base plate of a prestressing-bed casing a respective temporary covering, thereby blocking each plate hole, the large number of holes corresponding to the holes needed for several types of concrete cross ties;

b) determining and selecting the plate holes to be used for a predetermined type of concrete switch cross tie and unblocking the selected holes by removing the respective coverings;

c) providing on the base plate at each of the unblocked holes an anchor;

c) filling the prestressing-bed casing with concrete on the base plate over and around the anchors;

d) setting the concrete; and e) removing the set concrete and the anchors from the prestressing-bed casing as a tie with anchors imbedded in it at locations corresponding to the unblocked plate holes.

2. The tie-making process defined in claim 1 wherein the holes are blocked by plugs forming the coverings.

* * * * *